United States Patent [19]

Segovia

[11] 4,181,982

[45] Jan. 8, 1980

[54] STOCKING WITH CONVERTIBLE TOE OPENING

[76] Inventor: Iraida V. Segovia, 270 Upland Dr., San Francisco, Calif. 94127

[21] Appl. No.: 890,645

[22] Filed: Mar. 20, 1978

[51] Int. Cl.[2] ..... A41B 11/06

[52] U.S. Cl. ..... 2/239; 2/83

[58] Field of Search ..... 2/83, 80, 239, 61

[56] References Cited

U.S. PATENT DOCUMENTS 3,111,676 11/1963 Artzt et al. ..... 2/83 X

*Primary Examiner*—H. Hampton Hunter

*Attorney, Agent, or Firm*—J. Michael Rosso

[57] ABSTRACT

A nylon stocking having a toe opening and inner and outer toe closing bands adjacent thereto, the inner band extending across the inside of the sole portion and the outer band extending over the toe portion, each band being sewn at its ends to the sides of the stocking. From a closed position, with the toes extending under the inner band, the outer band is first pulled up and over the toes toward the instep, and the inner band is then pulled up and down under the toes, leaving the toes completely uncovered for taping, massaging, or the like.

3 Claims, 6 Drawing Figures

STOCKING WITH CONVERTIBLE TOE OPENING

BACKGROUND OF THE INVENTION

This invention relates to stockings, and more particularly to a stocking having a convertible toe opening.

A wide variety of stockings and other garments are available for allowing the toes to be uncovered from time to time, for different reasons. In children's sleepware, e.g., the leg portions of pajamas may be provided with adjustable end closures for permitting extension of the foot in keeping with the growth of the wearer, as disclosed in U.S. Pat. No. 2,705,326. See also U.S. Pat. Nos. 1,283,205 and 1,112,759. Therapeutic stockings have been developed, as disclosed in U.S. Pat. Nos. 3,975,929 and 4,027,667 for reducing the incidence of pulmonary embolism. However, none of such garments has been designed for the specific purpose of permitting the wearer to periodically uncover the toes, and accordingly, none has been satisfactory for such purpose.

U.S. Pat. No. 2,655,660 discloses a garment having a pair of tubular sleeves for enclosing the feet and legs of the wearer, with the toe portion being provided with an opening so that the wearer may keep his feet within the sleeves or may extend them through the opening. A flap or cover extends over the opening in the closed portion. Also, in U.S. Pat. No. 3,329,972, a stretch garment for infants is disclosed, the garment having a toe opening with an elastic toe piece for folding over the toe opening in the closed position. The elastic toe piece is folded to the open position so as to allow the infant's foot to move freely and to grow. Neither the tubular sleeve garment nor the infant's garment of such patents has been found practical or at all useful for allowing a wearer, adult as well as child, to quickly and easily uncover the toes of a conventional stocking.

SUMMARY OF THE INVENTION

In accordance with this invention there is provided a stocking having a convertible toe opening, the stocking comprising a leg enclosing portion and a foot enclosing portion, with the foot enclosing portion having an opening for the toes and inner and outer toe closing bands adjacent thereto, such that the wearer can fold first the inner band and then the outer band over the toes to completely enclose them. Preferably the stocking is formed of nylon or a similar elastic fabric, with the inner toe closing band extending across the inside of the sole portion and the outer band extending over the outside of the toe portion, the ends of each band being sewn to the sides of the stocking.

It is a primary object of this invention to provide a stocking in which the wearer can quickly and easily uncover the toes without having to remove the stocking from the legs.

It is another object to provide a conventional stocking whether elastic or non-elastic, having a convertible toe opening, the stocking including such convertible toe opening being of simple and inexpensive construction.

It is a further object to provide a ballet stocking with a convertible toe opening so that a performer can quickly expose the toes for taping, massaging and the like without having to remove the stocking.

It is a yet further object to provide a convertible toe opening for stockings worn by adults as well as children or infants.

These and other objects of the invention will become apparent to those skilled in the art from a reading of the description of the preferred embodiment, as well as from examining the following described drawings.

DESCRIPTION OF THE PREFERRED EMBODIMENT

Figure 1:
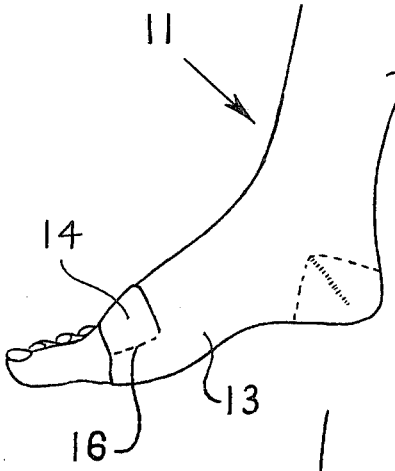
FIG. 1 is an elevational view of the foot enclosing portion of the stocking of this invention in fully open position.
Figure 2:
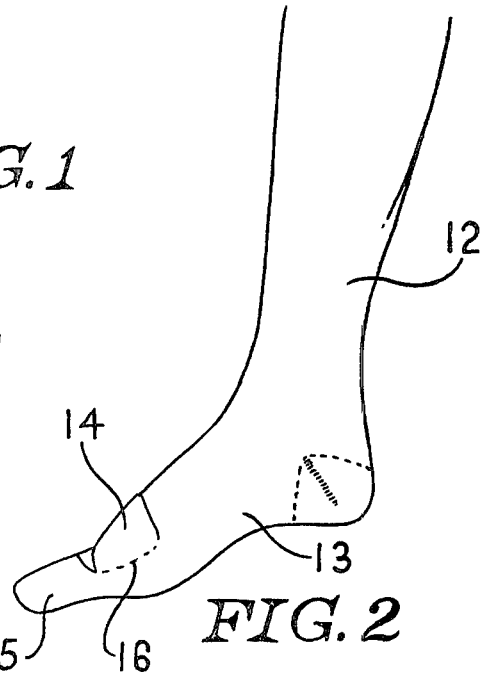
FIG. 2 is a view similar to FIG. 1 but showing the inner band in enclosing position over the toes.
Figure 3:
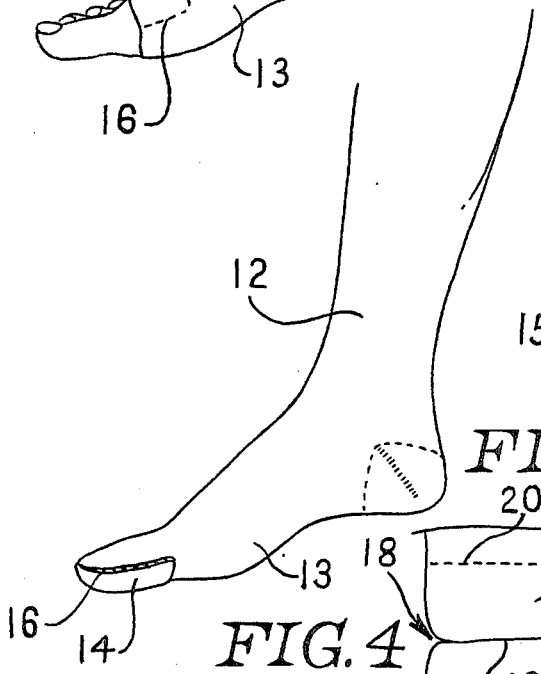
FIG. 3 is a view similar to FIG. 1 but showing the outer band pulled over the toes such that they are fully enclosed by both inner and outer bands.

FIGS. 1–3 show progressive positions of the convertible toe opening stocking of this invention, from the fully open position of FIG. 1 to the position of FIG. 3, where the toes are completely enclosed by both inner and outer toe closing bands. Referring to FIG. 1, stocking 11 is comprised of a leg enclosing portion 12 and a foot enclosing portion 13, the foot enclosing portion having an outer band 14 and an inner band 15 (shown in FIG. 2) joined together by a single seam 16. Both outer band 14 and inner band 15 can be rolled back toward the instep of the foot and further away from the toes, if desired.

In FIG. 2, inner toe closing band 15 has been pulled up and over the toes to a position adjacent outer toe closing band 14. Finally, in FIG. 3, outer toe closing band 14 has been pulled from the position shown in FIG. 2 over and under the toes to completely enclose them. Inner toe closing band 15 extends over the toes, while outer toe closing band 14 extends under the toes. It is noted that in the closed position of FIG. 3 the "finished" side of seam 16 faces outward, such that the stocking in such position has the appearance of a conventional stocking without any type of convertible toe opening.

To again uncover the toes, it is only necessary to reverse the above operations. That is, the outer toe closing band 14 is pulled up and over the toes to the position shown in FIG. 2, and the inner toe closing band is then pulled away and under the toes to the position shown in FIG. 1, so as to completely expose the toes. Preferably, the inner and outer toe closing bands 14, 15 are formed of an elastic material, such as nylon, or any other stretch fabric commonly used in stockings, such that the bands can be easily stretched over the toes and alternately rolled back toward the instep.

The convertible toe opening of the stocking of this invention is especially preferred for use in ballet stockings and similar stockings which enclose the entire leg extending up to the waist and further being worn under other garments, such as leotards. For example, ballet dancers frequently have to remove their stockings to uncover the toes for taping or the like. Since the ballet stockings are typically worn under other garments this operation requires considerable time and trouble. With the stocking of this invention, the toes can be quickly and easily uncovered without having to remove even the stocking, let alone any other garment worn by the dancer. Of course, the advantages of the convertible toe opening of this invention pertain to stockings which extend only above the knee as well as a ballet and similar stockings, since even here considerable time will be required to take the stockings off to expose the toes.

Figure 4:
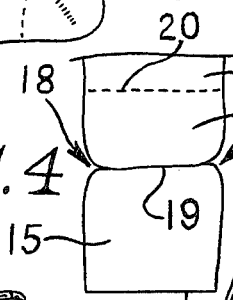
FIG. 4 is a plan view of the pattern for the foot enclosing portion of the stocking.

The toe portion of the stocking is formed with inner and outer toe closing bands starting with the wrong side out pattern shown in FIG. 4. Foot enclosing portion 13 terminates in a straight side 17, and has V-shaped indentations 18 on either side to provide the rounded toe portion of the complete stocking. The outer toe closing band 14 is shown after it has been folded, from a position coextensive with inner band 15, to within the toe opening 19. The straight side 20 of the outer band 14, before such folding under step, would be the same shape as unfolded band 15, as shown. Band 15 is then folded over the opening, and the four thicknesses of bands are sewn in one operation to the sides of the foot enclosing portion 13, giving the position of FIG. 5.

Figure 5:
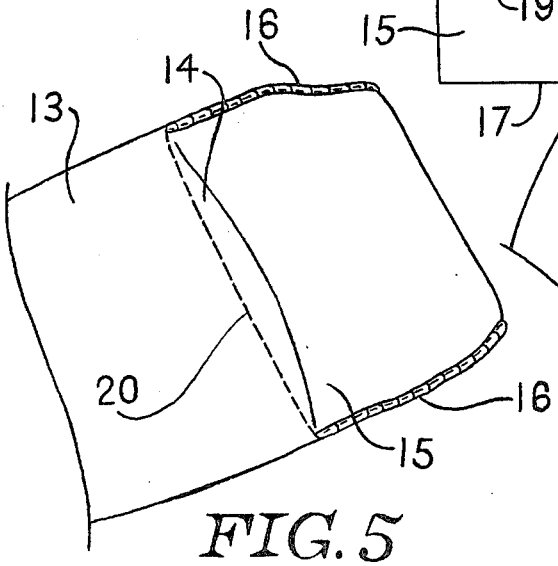
FIG. 5 is a plan view of the toe portion of the stocking, wrong side out.
Figure 6:
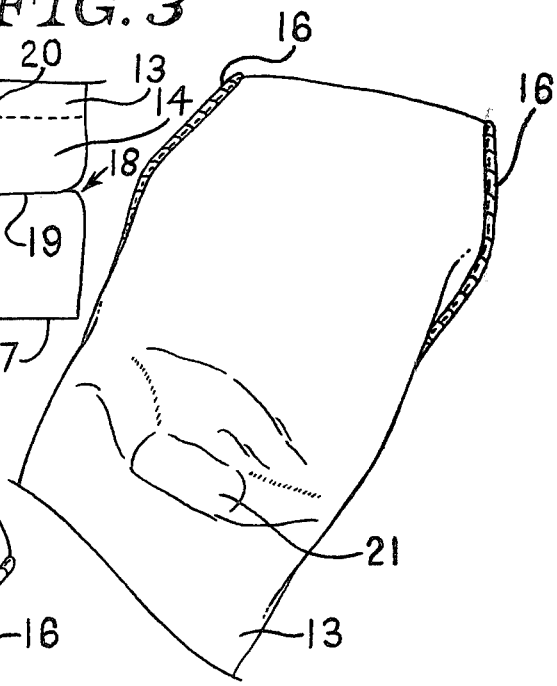
FIG. 6 is a bottom view of the sole portion of the stocking, wrong side out.

In FIG. 5, the toe portion of the stocking is shown wrong side out to further illustrate the attachment of the inner and outer toe closing bands to the sides of the stocking 11. Inner toe closing band 15 and outer toe closing band 14 are secured at their ends to stocking 11 by seam 16. FIG. 6 shows the bottom view of the toe portion shown in FIG. 5, with heel portion 21 at on end and seams 16 at the opposite end.

The use of a single seam 16 to attach both the inner and outer toe enclosing bands 14, 15 to the sides of the stocking 11, as shown in FIGS. 5, 6 renders the convertible toe opening stocking of this invention extremely inexpensive to fabricate. No special sewing operation or other modifications of a conventional stocking are required. The simplicity of construction of such stocking not only makes for low cost of the finished product, but results in a stocking of high esthetic appearance.

Although the outer band is shown on the instep portion of the stocking, it could be sewn across the bottom thereof. Similarly, the inner band could be in inverted position. The invention relates to the use of a pair of toe enclosing bands, rather than their specific placement adjacent the toe opening. Also, although stretch fabric is preferably used, it is possible to use non-elastic fabric to achieve the same or similar results.

I claim:

1. A stocking with a convertible toe opening comprising a leg enclosing portion extending above the wearer's knee, and a foot enclosing portion having an opening for the toes and inner and outer toe closing bands adjacent the opening, the inner band extending across the bottom of the foot enclosing portion and the outer band extending across the top of the foot enclosing portion, both bands being sewn together at the sides of the foot enclosing portion in a single horizontal seam, the foot enclosing portion being otherwise seamless whereby the wearer can fold first the inner band and then the outer band over the toes to completely enclose them.

2. The stocking of claim 1 wherein the inner and outer to closing bands are formed of an elastic material.

3. The stocking of claim 1 wherein the entire stocking, including the inner and outer toe closing bands, are formed of nylon.

* * * * *